US006604691B1

(12) United States Patent
Thomas et al.

(10) Patent No.: US 6,604,691 B1
(45) Date of Patent: Aug. 12, 2003

(54) SPRINKLER WITH WIND DRIVEN DEVICE

(75) Inventors: Joyce Thomas, Lexington, IL (US); Linda J. McMahill, Chillicothe, IL (US)

(73) Assignee: L. R. Nelson Corporation, Peoria, IL (US)

( * ) Notice: Subject to any disclaimer, the term of this patent is extended or adjusted under 35 U.S.C. 154(b) by 60 days.

(21) Appl. No.: 09/867,729

(22) Filed: May 29, 2001

(51) Int. Cl.[7] ..... B05B 15/06; A62C 31/22
(52) U.S. Cl. ..... 239/276; 239/273; 239/279
(58) Field of Search ..... 239/276, 200, 239/201, 207, 251, 225.1, 246, 255, 263, 261, 264, 71, 273, 275, 279; D23/213–219; 84/402, 403, 404

(56) References Cited

U.S. PATENT DOCUMENTS 3,667,673 A * 6/1972 Knudsen ..... 239/1
4,358,250 A * 11/1982 Payne ..... 417/302
5,092,556 A * 3/1992 Darling et al. ..... 248/519
5,236,166 A * 8/1993 Darling ..... 248/519
5,419,494 A * 5/1995 Harwood ..... 239/211
D361,121 S * 8/1995 Sellers ..... D23/214
6,166,310 A * 12/2000 Carter ..... 84/402
6,417,763 B1 * 7/2002 Petruzzi ..... 340/392.1

* cited by examiner

*Primary Examiner*—Davis Hwu
(74) *Attorney, Agent, or Firm*—Mayer, Brown, Rowe & Maw

(57) ABSTRACT

A irrigation device which has a sprinkler head and a wind driven device is disclosed. The device has a support frame which provides water to the sprinkler head. The support frame may include a number of pipes which supply water to the sprinkler head. The sprinkler head may have a rotating bearing and arms which are allow water to be sprayed out in various patterns. The force of the water also rotates the sprinkler head around the bearing. The support frame or sprinkler head also supports a wind driven device which may be audio, visual or both. For example, the support frame may suspend wind driven chimes.

22 Claims, 10 Drawing Sheets

SPRINKLER WITH WIND DRIVEN DEVICE

FIELD OF INVENTION

This invention relates to a sprinkler unit with an aesthetic wind driven feature. More specifically, a sprinkler unit having a frame mounting a rotating sprinkler head and a wind chime is disclosed.

BACKGROUND OF INVENTION

There has been a demand for irrigation in garden or lawn areas. One method of irrigating such areas is to use a network of pipes connected to sprinkler heads. The sprinkler heads are installed on vertical pipes which are installed to irrigate a certain area. The sprinkler heads are capped by a nozzle head which allows water to be forced out of the nozzle head, under pressure, in various spray patterns. The nozzle head design determines the spray pattern from the sprinkler head. In order to maximize the area which are covered by each of the sprinkler heads, the sprinkler heads are designed to rotate thus throwing water over a circular area.

Since gardens are often set up as outdoor decoration, it is desirable to have gardens or lawn areas be aesthetically pleasing. The sight of sprinkler heads or pipes is unsightly and may spoil the decorative effect of the garden. Additionally, the sprinkler heads may not be sufficiently adaptable if watering must be changed over a certain area or different plants requiring different watering are moved to the garden.

Another method of watering a lawn or a garden is through the use of a portable sprinkler which may be connected to a hose and then moved to any location desired. Through use of water pressure and various directional heads, different spray patterns may be obtained. This has the advantage of leaving the garden area in pristine condition when the watering is completed. Additionally, should a gardener change the location of the garden or the plants in the garden, the watering patterns may easily be adapted. However, a portable sprinkler suffers from the problem of requiring greater labor in order to irrigate an area. Furthermore, a portable sprinkler also ruins the aesthetic appeal of the garden area when it is employed.

Thus there exists a need for an aesthetically pleasing sprinkler which may be placed in a garden to provide irrigation. There is a further need for a combination sprinkler and support for garden plants. There is another need for a sprinkler which has devices which can create aesthetically pleasing effects when driven by the wind. There is also a need to provide an adaptable sprinkler which could be combined with wind driven devices for decorative effect when irrigating an area.

SUMMARY OF THE INVENTION

These and other needs may be addressed by the present invention which may be embodied in a combination sprinkler and wind driven ornament fixture for use with a pressurized fluid source. The fixture has a fluid inlet connector and a framework. A pipe is in fluid communication with the connector and supported by the framework. A fluid outlet is in fluid communication with the pipe. A wind driven device is suspended by the framework The present invention may also be embodied in a trellis sprinkler for use with a water source. The trellis sprinkler has a pair of vertical pipe supports having a bottom end and a top end. An arcuate pipe member is fluidly coupled to the top ends of the vertical pipe supports. A sprinkler head is fluidly coupled to the arcuate pipe member. A water source connector is coupled to one of the pair of vertical pipe supports. A cross rod is connected between the vertical pipe supports. A wind driven decorative device is suspended by the cross rod.

The invention may also be embodied in a decorative sprinkler for use with a water hose. The sprinkler has a vertical pipe having a bottom end and a top end. A hose coupler is fluidly coupled to the bottom of the pipe. A sprinkler head member is fluidly coupled to top end of the pipe and a wind driven decorative device suspended by the sprinkler head.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DESCRIPTION OF THE PREFERRED EMBODIMENT

Figure 1:
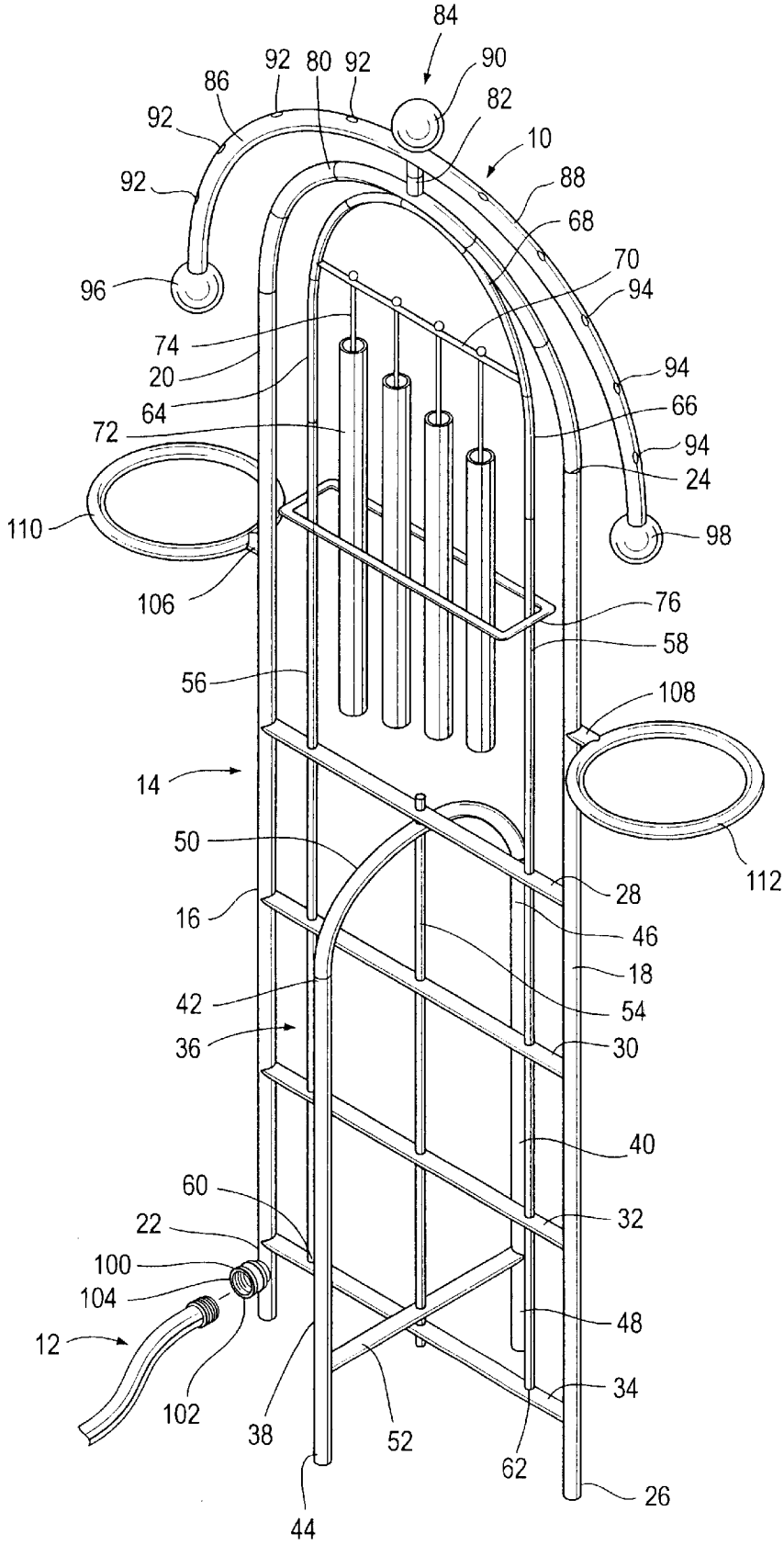
FIG. 1 is a perspective view of a trellis sprinkler according to one embodiment of the present invention.
Figure 2:
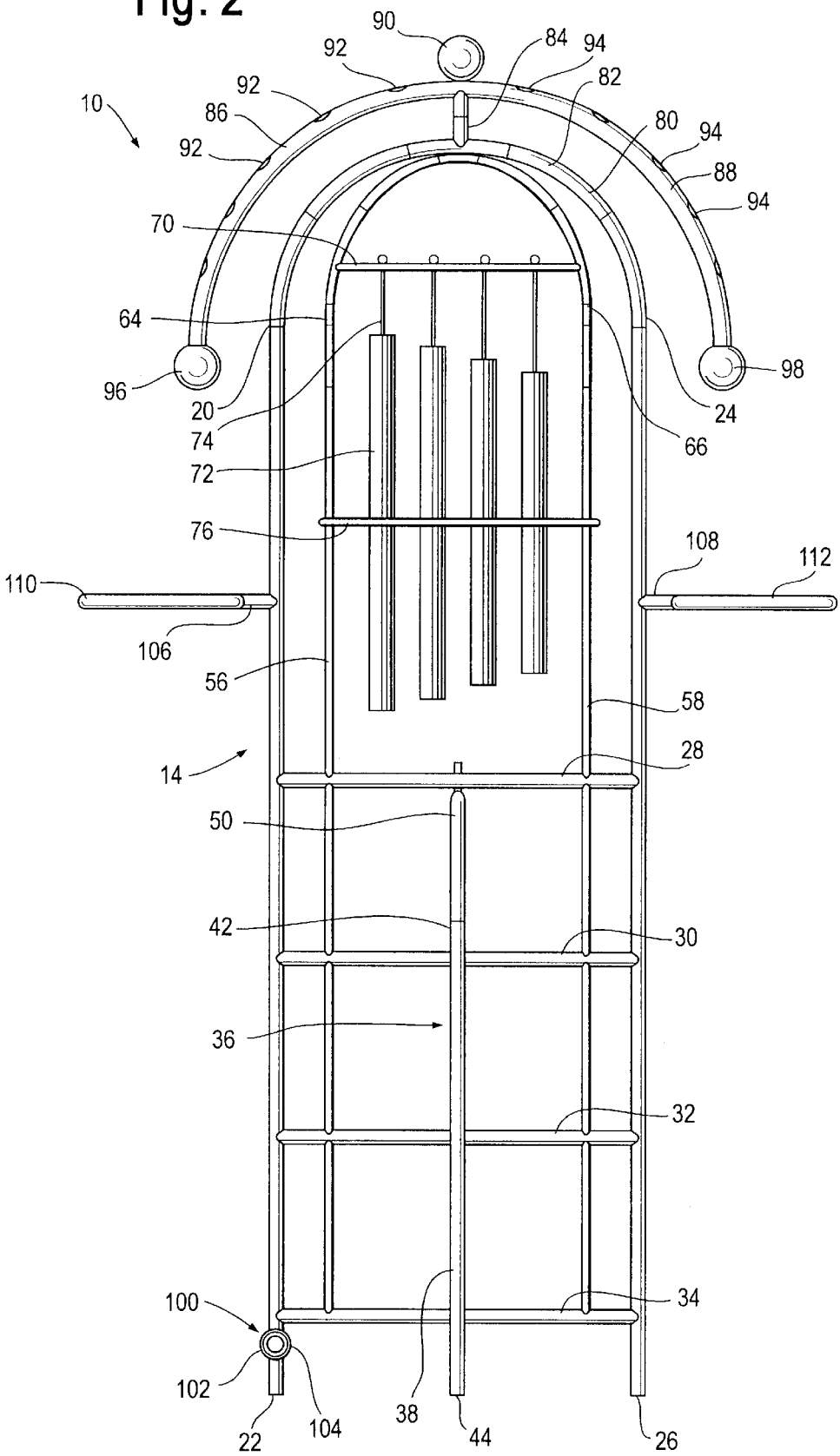
FIG. 2 is a front view of the trellis sprinkler of FIG. 1.
Figure 3:
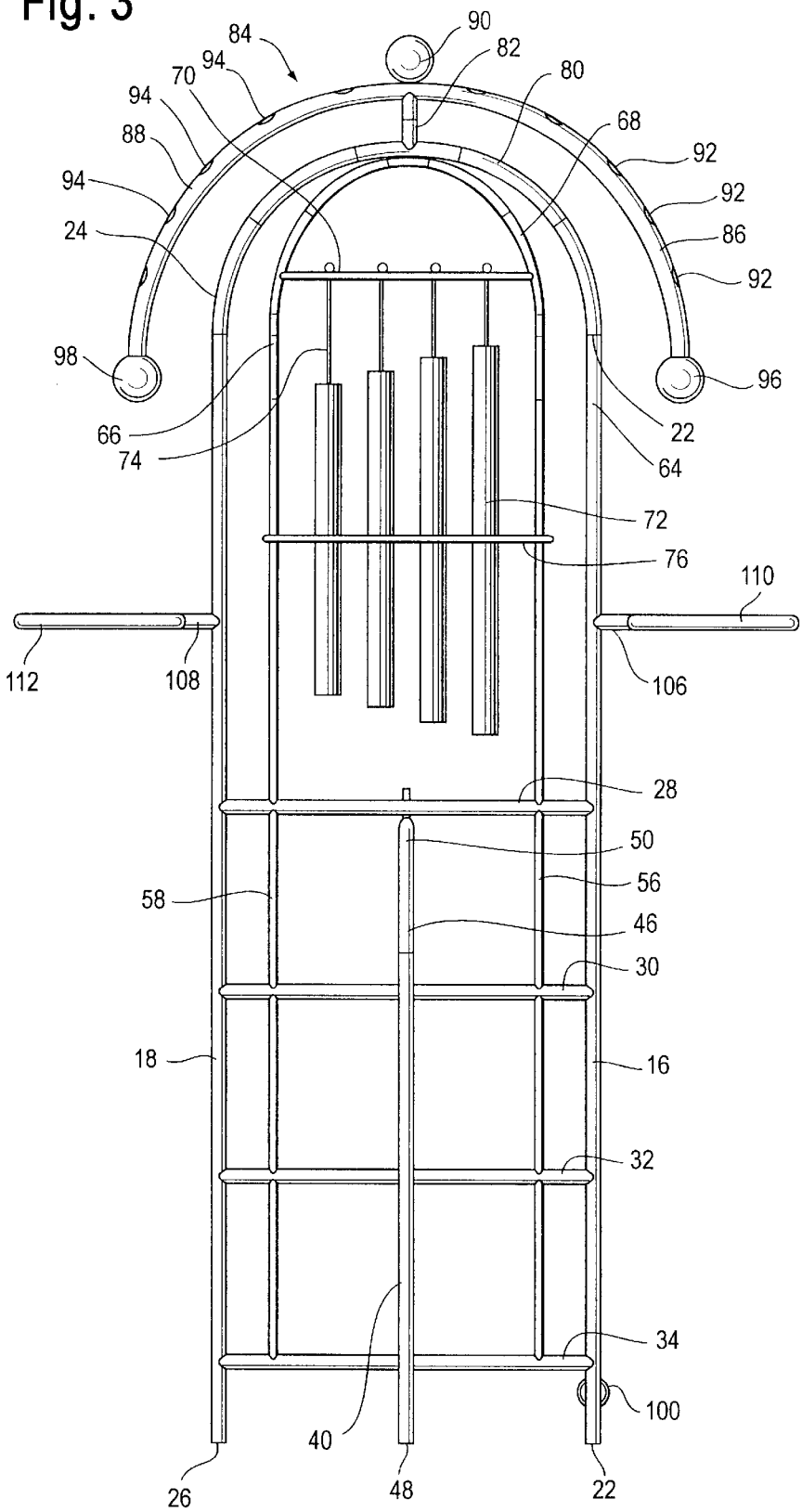
FIG. 3 is a back view of the trellis sprinkler of FIG. 1.
Figure 4:
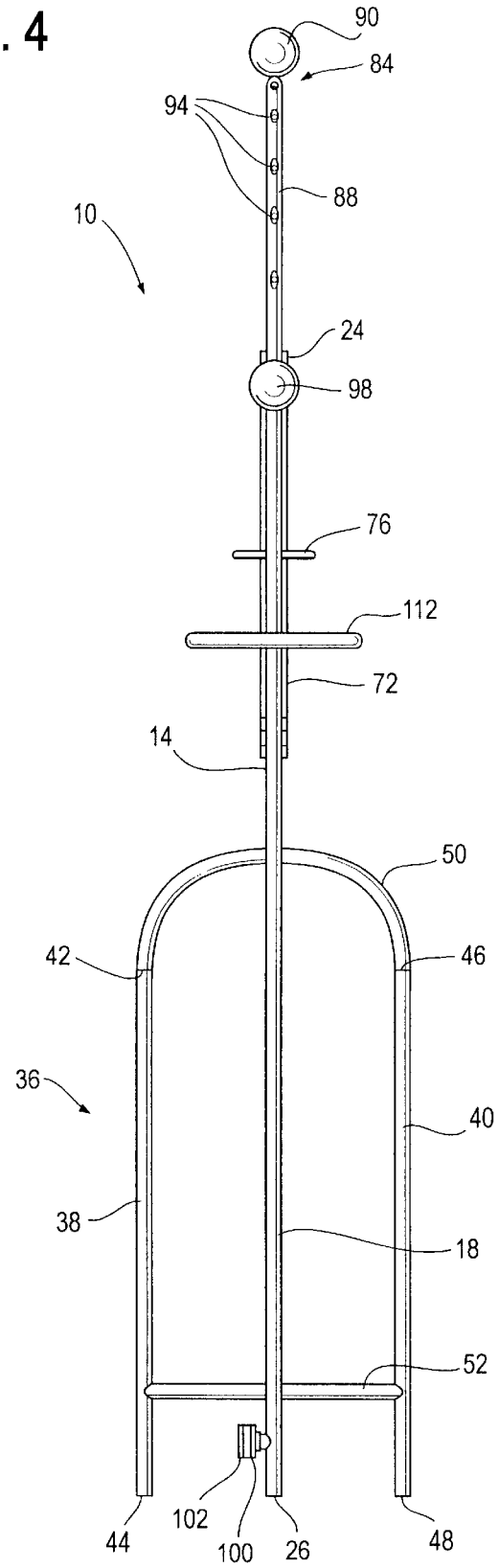
FIG. 4 is a side view of the trellis sprinkler of FIG. 1.
Figure 5:
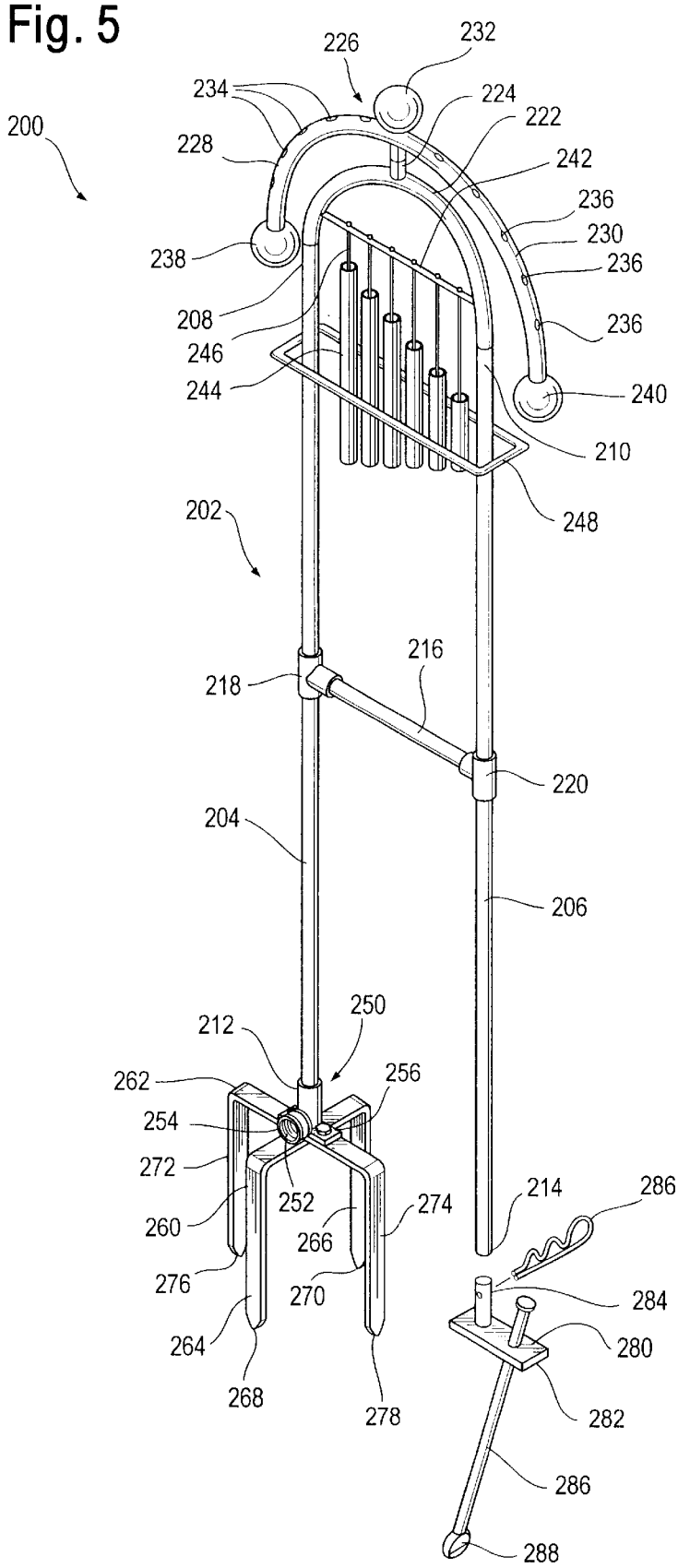
FIG. 5 is a perspective view of an alternate embodiment of a trellis sprinkler according to the present invention.
Figure 6:
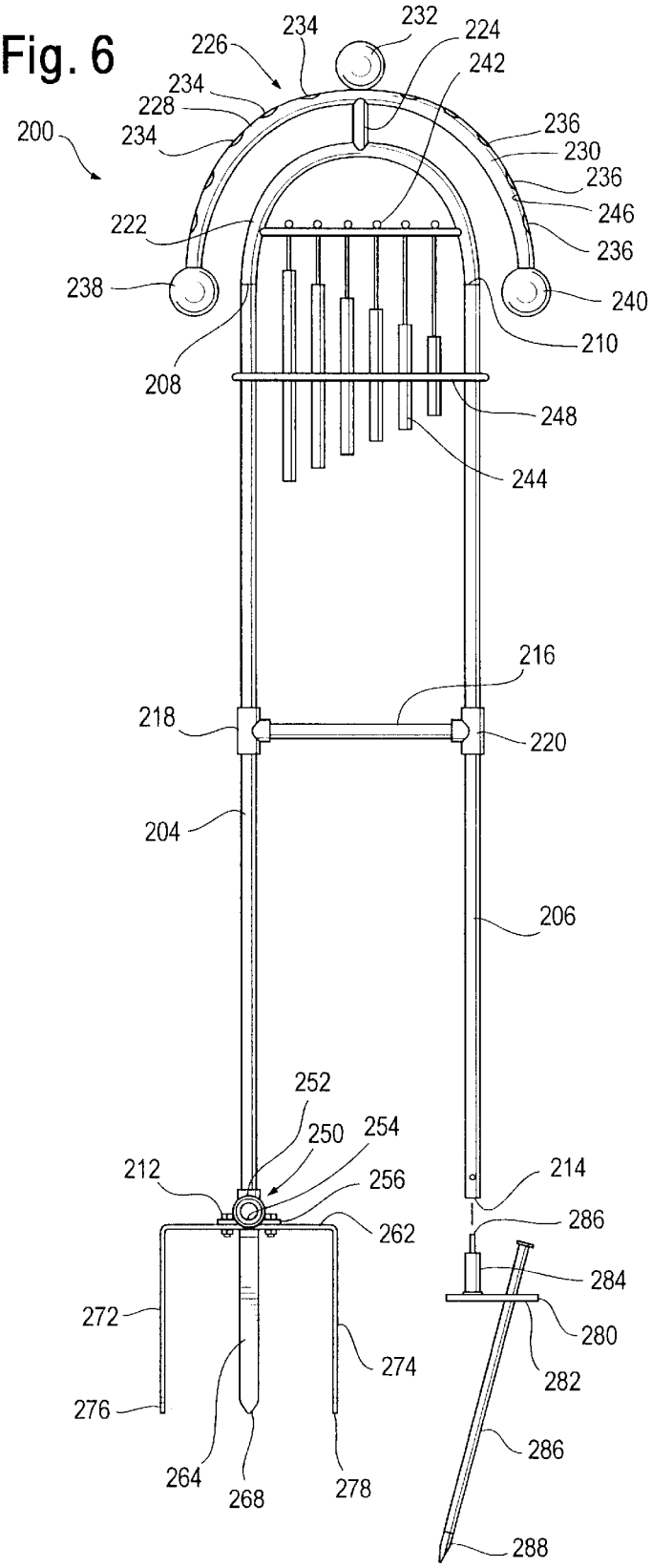
FIG. 6 is a front view of the trellis sprinkler of FIG. 5.
Figure 7:
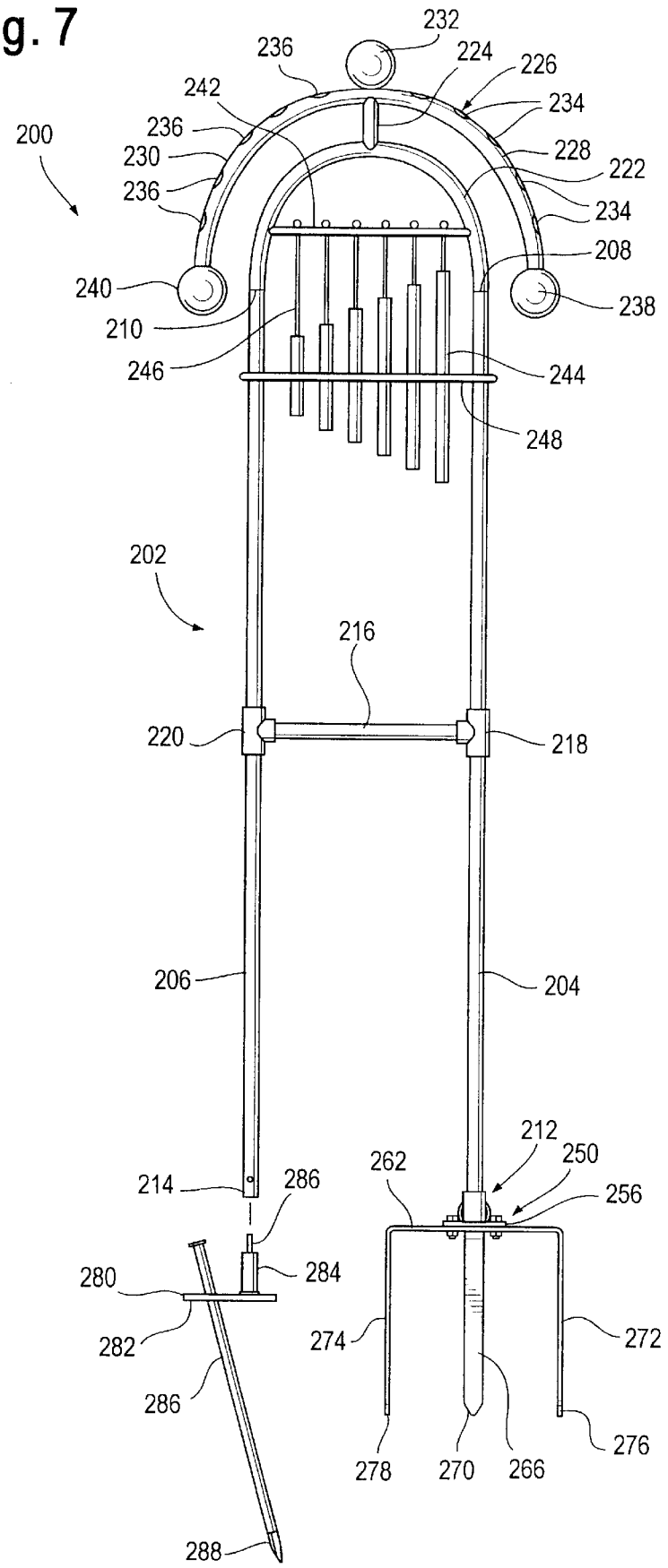
FIG. 7 is a back view of the trellis sprinkler of FIG. 5.
Figure 8:
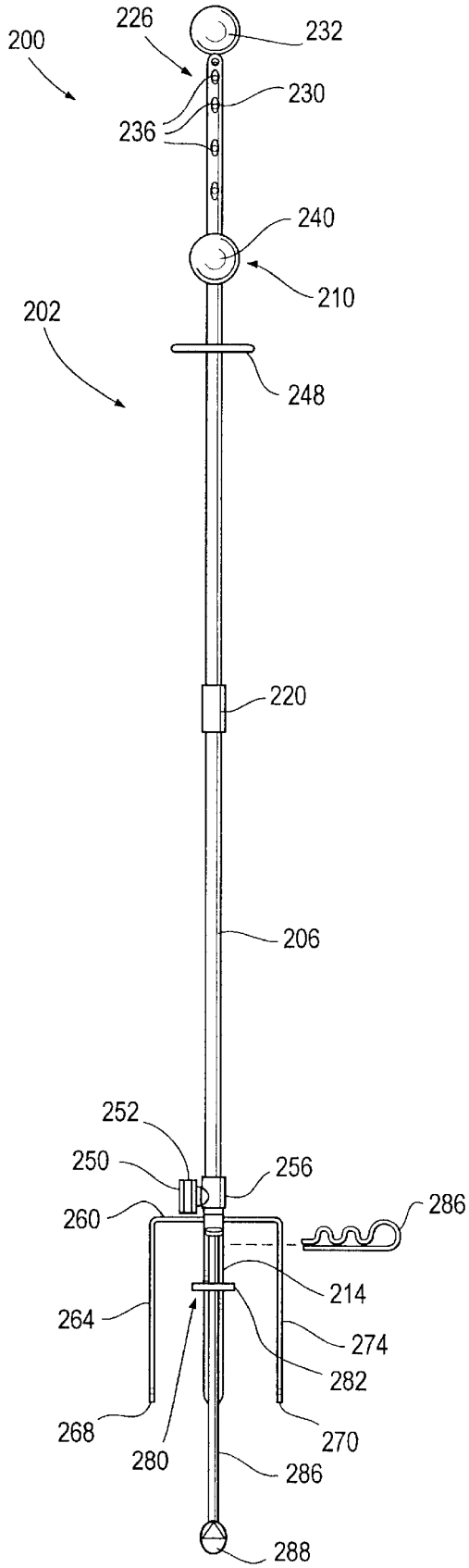
FIG. 8 is a side view of the trellis sprinkler of FIG. 5.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Referring now more particularly to FIGS. 1–4 of the drawings, there is shown therein a trellis sprinkler assembly generally indicated at 10, which is an embodiment of the present invention. The trellis sprinkler assembly 10 is connected to a hose 12 which supplies water from a spigot. The trellis sprinkler assembly 10 has a frame 14 which has two diametrically opposed main support pipes 16 and 18. The support pipes 16 and 18 are hollow and preferably constructed of copper or steel tubing and extend the length of the assembly. It is to be understood that other malleable materials such as aluminum or steel rods may be used as long as they may be formed into hollow piping which can support the assembly. It is to be understood that other configurations of the frame 14 may be used as long as they provide a sturdy base support. The support pipe 16 has a top end 20 and a bottom end 22. The support pipe 18 also has a top end 24 and a bottom end 26. A group of cross braces 28, 30, 32 and 34 connect along the length of the support pipes 16 and 18. The cross braces 28, 30, 32 and 34 are connected to the support pipes 16 and 18 by welding preferably but other means of connection such as brackets, bolts etc. may be used. A lateral support 36 is installed perpendicularly to the plane formed by the support pipes 16 and 18 and cross braces 28–34.

The lateral support 36 has a pair of vertical members 38 and 40. The vertical member 38 has a top end 42 and a bottom end 44. The vertical member 40 also has a top end 46 and a bottom end 48. An arcuate rod 50 joins the top end 42 of the vertical member 38 with the top end 46 of the vertical member 40. The arcuate rod 50 also is connected to the cross brace 28. A cross member 52 joins the vertical members 38 and 40 near their bottom ends 44 and 48. The cross member 52 also is connected to the cross brace 34.

The cross braces 28–34, arcuate rod 50 and cross member 52 each have a center hole through which a center shaft 54 is inserted therethrough to provide further stability to the frame 14. The cross braces 28–34 also have a pair of side holes through which a pair of secondary shafts 56 and 58 are inserted. The secondary shafts 56 and 58 each have a bottom end 60 and 62 respectively which are inserted in the cross brace 34. The secondary shafts 56 and 58 also have top ends 64 and 66 respectively. The top ends 64 and 66 of the secondary shafts 56 and 58 are joined by an arcuate member 68.

The top ends 64 and 66 of the secondary shafts 56 and 58 are also joined by a horizontal rod 70. The horizontal rod 70 allows the suspension of wind driven visual/audio devices. For example, a series of chimes 72 are suspended by strings 74 from the horizontal rod 70. A rectangular frame 76 is connected to the secondary shafts 56 and 58 to restrain the swinging of the chimes 72. The chimes 72 are blown against each other by wind resulting in pleasing tunes.

Other different numbers of chimes or different sound devices such as pipes, bells and wooden sticks may be employed with the frame 14. In addition, non percussion type wind driven devices may be employed where wind blowing across an opening produces sounds similar to that of a flute or a whistle. Furthermore, visually pleasing wind driven devices such as pin wheels, spinners, glass beads, ceramic beads, shells, stones, molded plastic shapes, crystal like icicles, fabric banners, etched plastic or glass panels, or stained glass panels may be combined with the sound devices or used alone for aesthetic value. Additionally, electronic devices may be activated by wind in order to provide greater decorative or audio effect such as lights, audio devices or mechanical elements.

The top end 20 of the support pipe 16 is fluidly connected to one end of an arcuate pipe 80 which has an opposite end joined to the top end 24 of the support pipe 18. The middle of the arcuate pipe 80 is joined to the arcuate member 68 to provide further support for the secondary shafts 56 and 58 supporting the horizontal rod 70 and the chimes 72. The arcuate pipe 80 has a rotating bearing 82 which provides fluid connection to a sprinkler head member 84. The sprinkler head member 84 in this example has a pair of arcuate arms 86 and 88. The sprinkler head member 84 has a decorative top orb 90. The arcuate arms 86 and 88 are hollow allowing water flow from the rotating bearing 82. The arcuate arm 86 has a series of water flow outlets 92 and the arcuate arm 88 has a series of water flow outlets 94. The ends of the arcuate arms 86 and 88 are connected to decorative orbs 96 and 98 respectively which are visually identical to the top orb 90. The sprinkler head member 84 is rotatable around the bearing 82. Water is supplied to the sprinkler head member 84 via a hose connector 100 on the bottom end 22 of the bottom support 16. The hose connector 100 in this example has a cylindrical body 102 with interior female threads 104 which may be connected to a male hose member.

It is to be understood that any type of compatible sprinkler head may be used rather than the configuration shown here. For example the spray outlets may be mounted on the orbs 90, 96 and 98 if desired. Furthermore, other sprinkler head shapes such as a circular ring, triangular, square or diamond shapes with decorative inner elements could be used. Additionally, additional outlets may be added such that the water strikes the wind driven device such as the chimes 72 for an additional visual or audio effect. The sprinkler head member 84 may be designed to be visually compatible with the shape of the frame 14 for maximum aesthetic effect.

It is also to be understood that the frame 14 may be of any shape or size so long as it provides water communication with the sprinkler head 84. The frame 14 may also be used as part of a garden such as for supporting climbing plants. The frame 14 may also be adapted to support other garden objects. The frame 14 in this example has a pair of side shafts 106 and 108 which extend from the support pipes 16 and 18 respectively. The side shafts 106 and 108 each have ring shaped flowerpot holders 110 and 112 respectively. The frame 14 may also be connected to hooks, hangers, arms etc. for supporting hanging baskets and the like.

In operation, the frame 14 may be mounted in place or the ends 22 and 26 of the support pipes 16 and 18 and the ends 44 and 48 of the support members 38 and 40 may be inserted into the ground. Pressurized water is supplied by the hose 12 connected to the hose connector 100. Alternatively if the frame 14 is fixed in place a permanent pipe may be connected to the hose connector 100. The water moves up the pipe support 16 and through the bearing 82 to the sprinkler head member 84. The water then moves down through the arms 86 and 88 and out through the spray outlet ports 92 and 94. The water exiting through the spray outlet ports 92 and 94 imparts rotational force causing the arms 86 and 88 to rotate on the bearing 82. The water streaming from the outlet ports 92 and 94 combined with the rotation of the sprinkler head 84 thus may also create a decorative effect. The frame 14 may thus be used to water nearby plants or plants which may be put in flowerpots on the flowerpot holders 110 and 112.

Another example of the present invention may be seen in a combination wind instrument and sprinkler 200 shown in FIGS. 5–8. The sprinkler 200 has a support frame 202 which has a pair of vertical support pipes 204 and 206. The support pipes 204 and 206 are hollow and have top ends 208 and 210 respectively and bottom ends 212 and 214 respectively. The support pipes 204 and 206 are connected by a lateral cross member 216. One end of the cross member 216 is inserted in a T-shaped coupler 218 which is joined to the middle of the support pipe 204. The other end of the cross member 216 is inserted in a T-shaped coupler 220 joined to the middle of the support pipe 206.

The top end 208 of the support pipe 204 is fluidly connected to one end of an arcuate pipe 222 which has an opposite end joined to the top end 210 of the support pipe 206. The middle of the arcuate pipe 222 has a rotating bearing 224 which provides fluid connection to a sprinkler head member 226. The sprinkler head member 226 in this example has a pair of arcuate arms 228 and 230 and is similar to the sprinkler head member 84 in FIGS. 1–4. The sprinkler head member 226 has a decorative top orb 232. The arcuate arm 228 has a series of water flow outlets 234 and the arcuate arm 230 has a series of water flow outlets 236. The ends of the arcuate arms 228 and 230 are connected to decorative orbs 238 and 240 respectively which are visually identical to the top orb 232. The sprinkler head member 226 is rotatable around the bearing 224.

The ends of the arcuate pipe 222 are joined by a horizontal rod 242. The horizontal rod 242 allows the suspension of wind driven visual/audio devices. For example, a series of chimes 244 are suspended by strings 246 from the horizontal rod 242. A rectangular frame 248 is connected to the support pipes 204 and 206 to restrain the swinging of the chimes 244. The chimes 244 are blown against each other or the support frame 246 by wind resulting in pleasing tunes. As explained above, any wind driven device may be used instead of the chimes 244.

The end 212 of the pipe support 204 is coupled to a hose connector 250. The hose connector 250 in this example has a cylindrical body 252 with interior female threads 254 which may be connected to a male hose member. The water moves up the pipe support 204 and through the bearing 224 to the sprinkler head member 226. The water then moves down through the arms 228 and 230 and out through the spray heads 232 and 234. The water exiting through the spray heads 232 and 234 imparts rotational force causing the arms 228 and 230 to rotate on the bearing 224. The frame 202 may thus be used to water nearby plants.

The hose connector 250 is mounted on a plate 256. The plate 256 is bolted to two braces 260 and 262. The brace 260 has two vertically extending legs 264 and 266 which each have a spike shaped end 268 and 270 respectively. The brace 262 also has two vertically extending legs 272 and 274 which each have a spike shaped end 276 and 278 respectively.

The bottom end 214 of the pipe support 206 is connected to a brace 280. The brace 280 has a plate 282 which has a top surface with a pipe 284 attached. The bottom end 214 of the pipe support 206 is inserted over the pipe 284. The bottom end 214 of the pipe support 206 and the pipe 284 have a lateral hole. A pin 286 is inserted through the bottom end 214 of the support pipe 206 and pipe 284 via the lateral hole to lock the support pipe 206 to the brace 280. The plate 282 also has a rod 286 which has a spiked end 288. The real 286 is installed at an angle to the plate 282 in order to provide better stability and support. The frame 200 may be installed in a flat area by inserting the spiked ends 268, 270, 276 and 278 into the ground and the spiked end 288 of the rod 286. This provides a stable base for the frame 204 to be supported in an upright position. Of course other mounting methods could be employed.

Figure 9:
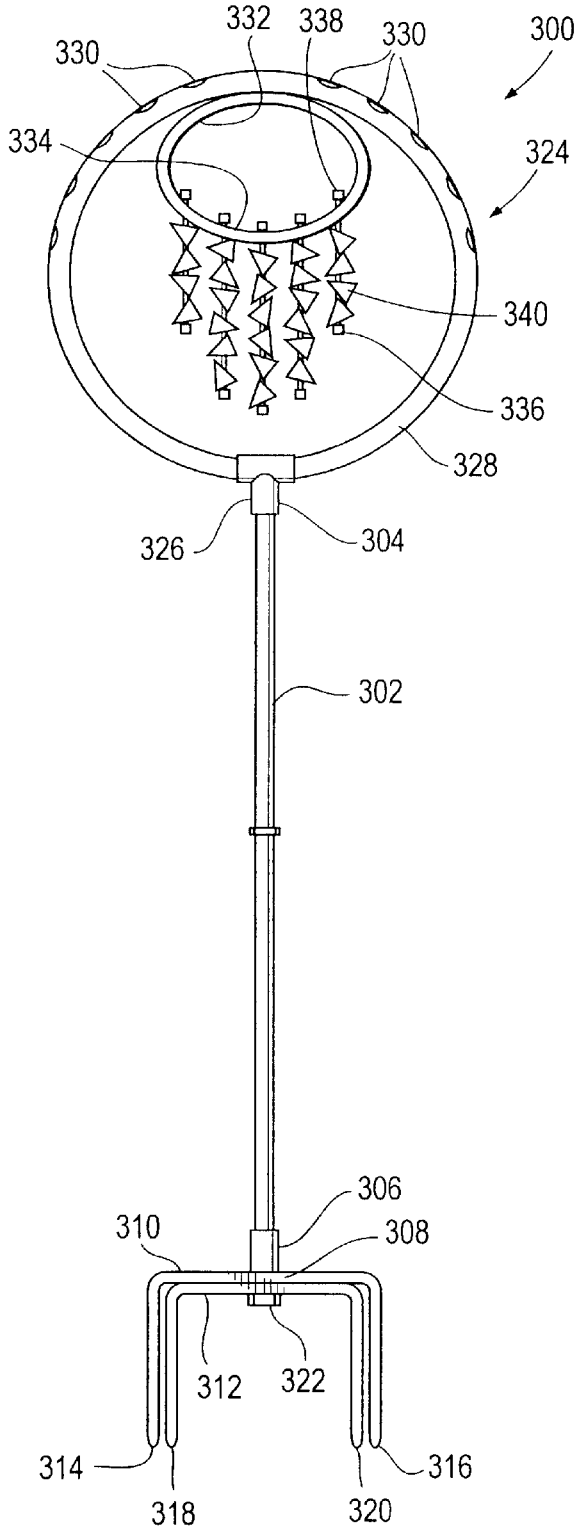
FIG. 9 is a perspective view of a second alternate embodiment of a whirling sprinkler according to the present invention.

Another alternative sprinkler configuration may be seen in a whirling decorative sprinkler 300 shown in FIG. 9. The sprinkler 300 has a central support pipe 302. The central support pipe 302 has a top end 304 and a bottom end 306. The bottom end 306 is mounted on a support base 308. A pair of bracing members 310 and 312 are bolted to the top of the support base 308. The bracing member 310 has a pair of vertical spikes 314 and 316 and the bracing member 312 has a pair of vertical spikes 318 and 320. The sprinkler 300 may thus be fixed by inserting the spikes 314–320 into the ground. The bottom end 306 of central support pipe 302 is fluidly connected to a hose connector 322 which is located on the support base 308.

The top end 304 of the support pipe 302 is fluidly coupled to a sprinkler head 324 via a rotating bearing 326. The sprinkler head 324 in this example has a circular pipe 328 which has a number of water outlets 330. Water pressure from the pipe 302 causes water to exit the sprinkler head 324 via the water outlets 330. The force from the water also causes the circular pipe 328 to rotate on the bearing 326.

A suspended oval frame member 332 is attached to the bottom of the circular pipe 328. The oval frame member 332 has a number of mounting holes 334. Each of the mounting holes 334 contains a string 336 tied to a peg 338. The strings 336 suspend a number of decorative beads 340. Preferably, the decorative beads are acrylic and either given a tiki or colored pattern or are clear. When the wind blows the beads 340 they hit each other and produce sounds. Additionally, when the sprinkler head 324 is activated, the water spray in combination with the beads 340 create an aesthetic effect.

Figure 10:
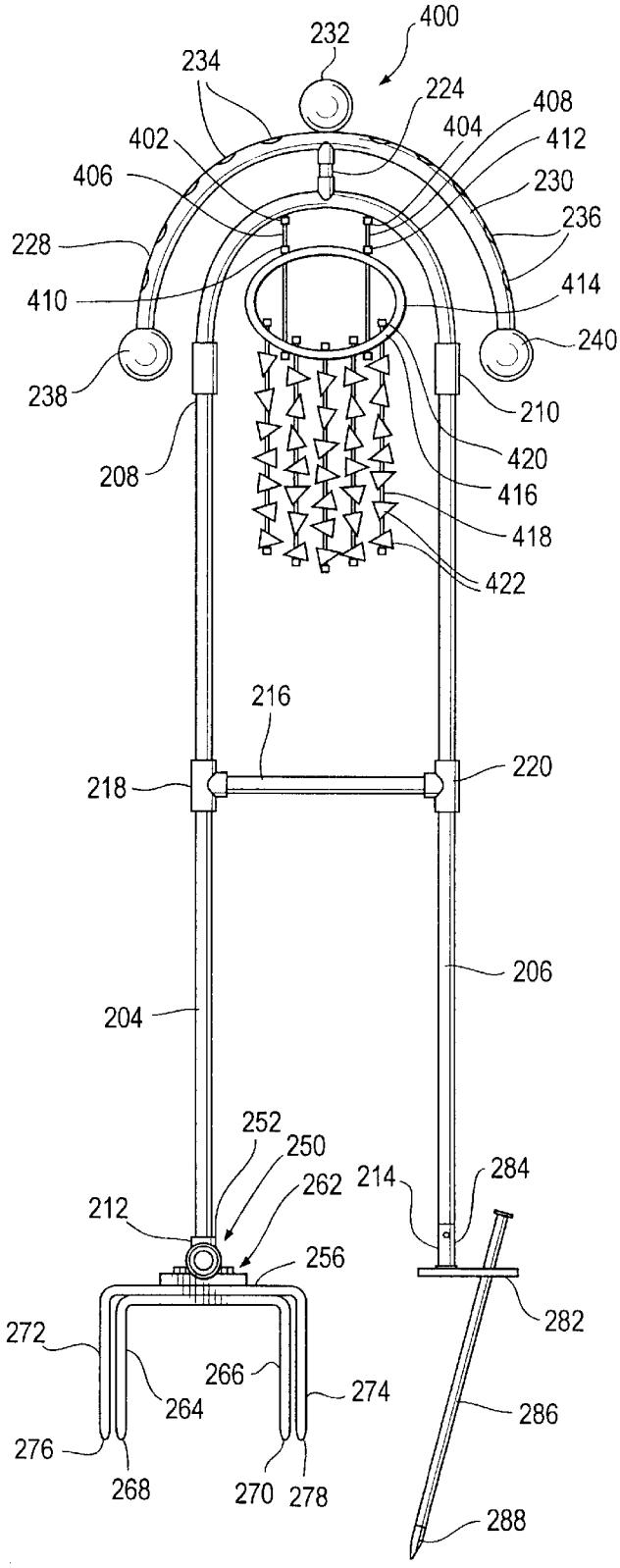
FIG. 10 is a perspective view of a third d alternate embodiment of a whirling sprinkler according to the present invention.

Another alternative sprinkler configuration may be seen in the decorative sprinkler 400 shown in FIG. 10. The sprinkler 400 is similar to the sprinkler 200 described in FIGS. 5–8 and thus identical parts have identical element numbers in FIG. 10. The wind chimes 244 and their mounting supports have been replaced in the sprinkler 400. A pair of rings 402 and 404 are connected to the arcuate pipe 222 under the rotating bearing 224. A pair of wires 406 and 408 are tied to the rings 402 and 404 respectively. The other end of the wires 406 and 408 are tied to a pair of rings 410 and 412 which are connected to a suspended oval frame member 414. The oval frame member 414 has a number of mounting holes 416. Each of the mounting holes 416 contains a string 418 tied to a peg 420. The strings 418 contain a number of decorative beads 422. When the wind blows the beads 422 they hit each other and produce sounds. The beads 422 may be made with attractive colors or patterns to further enhance the aesthetic effect of the sprinkler 400.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A combination sprinkler and wind driven ornament fixture for use with a pressurized fluid source, comprising:

a fluid inlet connector;

a framework;

a pipe in fluid communication with the connector and supported by the framework;

a fluid outlet in fluid communication with the pipe;

a wind driven device suspended by the framework; and wherein the framework has a vertical support pipe joined to one end of an arcuate pipe, the pipe coupled to the other end of the arcuate pipe, and the water outlet is located on the arcuate pipe.

2. The fixture of claim 1 wherein the wind driven device creates an audible noise on activation by wind.

3. The fixture of claim 2 wherein the wind driven device includes a series of chimes suspended by a rod connected to the pipe network.

4. The fixture of claim 1 wherein the fluid outlet is a sprinkler head.

5. The fixture of claim 4 wherein the sprinkler head includes a rotating bearing and a hollow arm having one end fluidly coupled to the rotating bearing, wherein the arm is rotatable around the bearing when fluid pressure is applied to the sprinkler head.

6. The fixture of claim 5 wherein the arm further includes a fluid spray outlet which causes pressurized fluid to spray out from the arm.

7. The fixture of claim 5 wherein the arm further includes an opposite end with a spray head.

8. The fixture of claim 1 wherein the wind driven device creates a visual effect when activated by the wind.

9. The fixture of claim 1 further comprising a ring shaped flowerpot holder coupled to the vertical support pipe.

10. The fixture of claim 1 further comprising a stand insertable in the ground to support the framework.

11. A trellis sprinkler for use with a water source, comprising:

a pair of vertical pipe supports having a bottom end and a top end;

an arcuate pipe member fluidly coupled to the top ends of the vertical pipe supports;

a sprinkler head fluidly coupled to the arcuate pipe member;

a water source connector coupled to one of the pair of vertical pipe supports;

a cross rod connected between the vertical pipe supports; and a wind driven decorative device suspended by the cross rod.

12. The trellis sprinkler of claim 11 wherein the wind driven device creates an audible noise on activation by wind.

13. The trellis sprinkler of claim 12 wherein the wind driven device includes a series of chimes suspended by the cross rod.

14. The trellis sprinkler of claim 11 wherein the sprinkler head includes rotating bearing and an arm having one end fluidly coupled to the rotating bearing and an opposite end with a spray head, the arm rotatable on the bearing when water pressure is applied to the sprinkler head via the water source connector being coupled to the water source connector.

15. The trellis sprinkler of claim 11 further comprising:

an upper cross brace between the vertical pipe supports;

a lower cross brace between the vertical pipe supports;

a cross support frame which has a pair of support members having top ends joined by an arcuate member and bottom ends joined by a support member, wherein the arcuate member is connected to the upper cross brace and the support member is connected to the lower cross brace.

16. The trellis sprinkler of claim 15 further comprising a ring flowerpot holder coupled to one of the vertical support pipes.

17. The trellis sprinkler of claim 11 further comprising a stand with spikes insertable in the ground coupled to the bottom of the vertical pipe supports.

18. A decorative sprinkler for use with a water hose, the sprinkler comprising:

a vertical pipe having a bottom end and a top end;

a hose coupler fluidly coupled to the bottom of the pipe;

a sprinkler head member fluidly coupled to top end of the pipe, the sprinkler head includes a rotating bearing and a circular pipe having a spray outlet, wherein application of water to the pipe causes the sprinkler head to rotate; and a wind driven decorative device suspended by the sprinkler head.

19. The sprinkler of claim 18 wherein the wind driven decorative device includes a plurality of strings each with beads.

20. A combination sprinkler and wind driven ornament fixture for use with a pressurized fluid source, comprising:

a fluid inlet connector;

a framework;

a pipe in fluid communication with the connector and supported by the framework;

a fluid outlet in fluid communication with the pipe; and a plurality of chimes suspended by a rod connected to the pipe network;

wherein the fluid outlet is a sprinkler head including a rotating bearing and a hollow arm having one end fluidly coupled to the rotating bearing, wherein the arm is rotatable around the bearing when fluid pressure is applied to the sprinkler head.

21. The fixture of claim 20 wherein the arm further includes a fluid spray outlet which causes pressurized fluid to spray out from the arm.

22. The fixture of claim 20 wherein the arm further includes an opposite end with a spray head.

* * * * *